US006827011B2

(12) United States Patent
Liebler et al.

(10) Patent No.: US 6,827,011 B2
(45) Date of Patent: Dec. 7, 2004

(54) PRINTERS COMPRISING A DRIVE ASSEMBLY AND A COUPLING

(75) Inventors: Manfred Herrmann Liebler, Erlenbach (DE); Bernd Kurt Masuch, Kürnach (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 171 days.

(21) Appl. No.: 10/363,691

(22) PCT Filed: Sep. 17, 2001

(86) PCT No.: PCT/DE01/03558

§ 371 (c)(1),
(2), (4) Date: Mar. 12, 2003

(87) PCT Pub. No.: WO02/24453

PCT Pub. Date: Mar. 28, 2002

(65) Prior Publication Data

US 2004/0103802 A1 Jun. 3, 2004

(30) Foreign Application Priority Data

Sep. 20, 2000 (DE) ..... 100 46 376

(51) Int. Cl.[7] ..... B41F 5/16

(52) U.S. Cl. ..... 101/177; 101/217; 101/219; 101/248; 101/183

(58) Field of Search ..... 101/177, 211, 101/219, 217, 183, 248, 216

(56) References Cited

U.S. PATENT DOCUMENTS

| | | | | | |
|---|---|---|---|---|---|
| 3,329,086 | A | * | 7/1967 | Pullen | 101/177 |
| 3,452,672 | A | * | 7/1969 | Bolza-Schünemann et al. | 101/177 |
| 4,217,823 | A | * | 8/1980 | Burger | 101/248 |
| 4,394,835 | A | * | 7/1983 | Gertsch et al. | 101/177 |
| 4,398,464 | A | * | 8/1983 | Morbitzer et al. | 101/177 |
| 4,696,229 | A | | 9/1987 | Bezler et al. | |
| 4,753,168 | A | | 6/1988 | Theilacker et al. | |
| 4,934,265 | A | * | 6/1990 | Knauer | 101/177 |
| 5,363,762 | A | * | 11/1994 | Belanger | 101/177 |
| 5,699,735 | A | | 12/1997 | Stein et al. | |
| 5,950,538 | A | * | 9/1999 | Puschnerat | 101/217 |
| 6,032,579 | A | * | 3/2000 | Richards | 101/219 |
| 6,332,397 | B1 | | 12/2001 | Bolza-Schünemann et al. | |
| 6,408,748 | B1 | | 6/2002 | Hajek et al. | |
| 6,647,874 | B1 | * | 11/2003 | Siegl et al. | 101/211 |
| 2001/0017087 | A1 | | 8/2001 | Schenider et al. | |
| 2001/0037737 | A1 | * | 11/2001 | Koppelkamm et al. | 101/147 |

FOREIGN PATENT DOCUMENTS

| | | | |
|---|---|---|---|
| DE | 44 30 693 | A1 | 3/1996 |
| DE | 195 01 243 | A1 | 7/1996 |
| DE | 196 03 663 | A1 | 8/1997 |
| DE | 197 32 330 | A1 | 2/1999 |
| EP | 0 196 019 | | 10/1986 |
| EP | 0 243 721 | | 11/1987 |
| EP | 0 644 048 | A2 | 3/1995 |
| EP | 0 710 558 | A1 | 5/1996 |
| EP | 0 882 588 | A1 | 12/1998 |
| EP | 0 644 048 | | 7/1999 |
| WO | WO 99/06211 | | 2/1999 |

* cited by examiner

*Primary Examiner*—Eugene H. Eickholt
(74) *Attorney, Agent, or Firm*—Jones, Tullar & Copper PC

(57) ABSTRACT

A printer includes a cylinder pair that consists of a forme cylinder and a transfer cylinder. A satellite or steel cylinder forms a print position as it cooperates with the transfer cylinder of the cylinder pair. The form cylinder and the transfer cylinder are a fixed coupling driver assembly which is driven by a common drive motor. The drive assembly of the cylinder pair and a drive system for the satellite or steel cylinder can be selectively mechanically coupled with each other by use of a coupling.

33 Claims, 13 Drawing Sheets

PRINTERS COMPRISING A DRIVE ASSEMBLY AND A COUPLING

FIELD OF THE INVENTION

The present invention is directed to a printing unit including a forme cylinder and a transfer cylinder. A satellite cylinder cooperates with the transfer cylinder to provide a print location.

BACKGROUND OF THE INVENTION

A printing press is known from EP 0 644 048 B1. Pairs of cylinders, each consisting of a forme and a transfer cylinder, are mechanically fixedly coupled. Each cylinder pair has its own drive motor. The cylinder pairs themselves cannot be coupled to each other.

DE 44 30 693 A1 discloses printing units of a printing press with separate configurations of cylinders which are driven individually or in groups. Cylinders, or groups of cylinders are not in a driven connection with each other.

A four-cylinder printing unit is known from DE 196 03 663 A1. Two transfer cylinders, which cooperate with each other, are fixedly coupled to each other and can be selectively driven by the drive mechanism of one or of both associated forme cylinders. In one embodiment, a pair of cylinders, consisting of a forme cylinder and a transfer cylinder, which can be driven at the forme cylinder, can be placed against this four-cylinder printing unit, and can be coupled into the drive assembly between the two first mentioned transfer cylinders for synchronization, or correctly registered printing.

EP 0 710 558 A1 discloses two printing towers, each of satellite construction, of mechanically coupled forme and transfer cylinders arranged in pairs, which are driven by a common motor. A web can be passed through both printing towers. In case of a change in production, one printing tower is taken out of operation while the other printing tower continues to print.

A drive mechanism of a printing unit for a flying plate change is known from EP 0 243 721 A2. The driving takes places from a main drive fixed against relative rotation to the counter-pressure cylinder. Forme and transfer cylinders, mechanically coupled in pairs, can be selectively coupled via a switchable connector with the driven counter-pressure cylinder.

SUMMARY OF THE INVENTION

The object of the present invention is directed to providing a printing unit.

In accordance with the present invention, this object is attained by the provision of a printing unit having a cylinder pair comprised of a forme cylinder and a transfer cylinder. A satellite cylinder cooperates with the transfer cylinder to form a print location. The forme cylinder drive and the transfer cylinder drive are coupled together during printing and are driven by a common drive motor. A drive mechanism for the satellite cylinder can be selectively switched via a switchable coupling or connector and can be mechanically coupled with the drive assembly for the cylinder pair.

The advantages which can be gained by the present invention lie, in particular, in that a great operational diversity and variability of a printing unit or of compound cylinders, along with a high degree of operational dependability, is provided, without each cylinder being provided with its own drive mechanism. The present invention combines the advantages of the substantial flexibility afforded by the expensive and elaborate single drive technology, with the advantages of coupled cylinder groups, namely the savings of motors and the mechanical synchronization of the connected cylinders.

As a rule, by the provision of the advantageous arrangement of switchable couplings and motors in accordance with the present invention, as many of the desired operating modes are possible as would be the case with the embodiment where all cylinders are provided with separate motors. Thus, with the coupling released, it is possible to move cylinders, or groups of cylinders, independently of each other, which is required, for example, when the printing formes or rubber blankets are exchanged, when a paper web is drawn in, or when rollers and cylinders are independently inked or washed. In many cases, an auxiliary drive mechanism can be omitted, since the function of this auxiliary drive mechanism can be taken over by the main drive mechanisms, if the couplings are appropriately switched. In the same way, is it possible to perform the switching of individual cylinders or cylinder groups of connected larger cylinders, in that new drive assemblies are formed by releasing couplings and by activating other couplings.

Moreover, a substantial advantage lies in the option of standardizing individual small groups, which meet the above mentioned requirements, for example a pair of cylinders consisting of a forme cylinder and a transfer cylinder with an appropriate coupling, and of combining these standardized small groups in any desired way, depending on the request made in the purchase order, into larger units. An above mentioned cylinder pair with a coupling can also represent a standard group, together with a counter-pressure or satellite cylinder. The journals of the cylinders can be configured as required, for example selectively with or without coupling, or with a gear wheel which can be fixed against relative rotation or can be fixed in place, and matching a first or second drive level.

In particular, in connection with printing units which can be switched from rubber-on-rubber to rubber-on steel operation, i.e. printing units in which at least one of the transfer cylinders can be selectively placed against a satellite cylinder or a second transfer cylinder, a reversal of the direction of rotation of one or several cylinders becomes necessary, depending on the unit. With a five-cylinder printing unit, an embodiment with one drive motor per pair of forme and transfer cylinders is advantageous, in which the satellite cylinder can be coupled with one of the two or with both drive motors, or pairs, depending on the paper guidance path and the mode of printing unit operation. For a seven-cylinder y- or lambda unit, which can be flexibly employed, for example, for a 3/0, or a 2/1 production run, the flying plate change, or during the imprint function in the course of 1/1 printing, an embodiment with only a total of two drive motors is sufficient for all requirements. Moreover, a 1/0 and a 1/1 production run is possible during two-web operations.

The present invention can also be employed particularly advantageously and efficiently in nine-cylinder or in ten-cylinder printing units. In such units, maximum flexibility, along with a minimal number of motors, is required in view of the modes of operation to be met.

A minimum requirement, the independent fitting in pairs of the pairs of cylinders when a web has been drawn in, is realized with minimum outlay in an advantageous configuration. One, or several pairs of cylinders form a fixed drive assembly, and the satellite cylinder, which is embodied without its own drive motor, can be selectively coupled in or released.

The embodiment of each cooperating and fixedly coupled cylinder pair with a drive motor is advantageous here, wherein at least two of these pairs can be coupled with the satellite by use of a switchable connector. With the savings of two connectors, the embodiment with only two cylinder pairs switchably coupled to the satellite cylinder is advantageous in nine- or ten-cylinder printing units. In this way, the satellite can be driven by the respectively other coupleable pair during partial reversal or stopping of a pair.

The selective coupling of a fixed drive assembly of the cylinder pair with a counter-pressure cylinder is the basis of the previously discussed great variety of operating modes.

The substantial operational dependability provided because of the redundancy in the number of usable drive motors, is also advantageous in the case of several drive mechanisms which can be coupled by of connectors.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
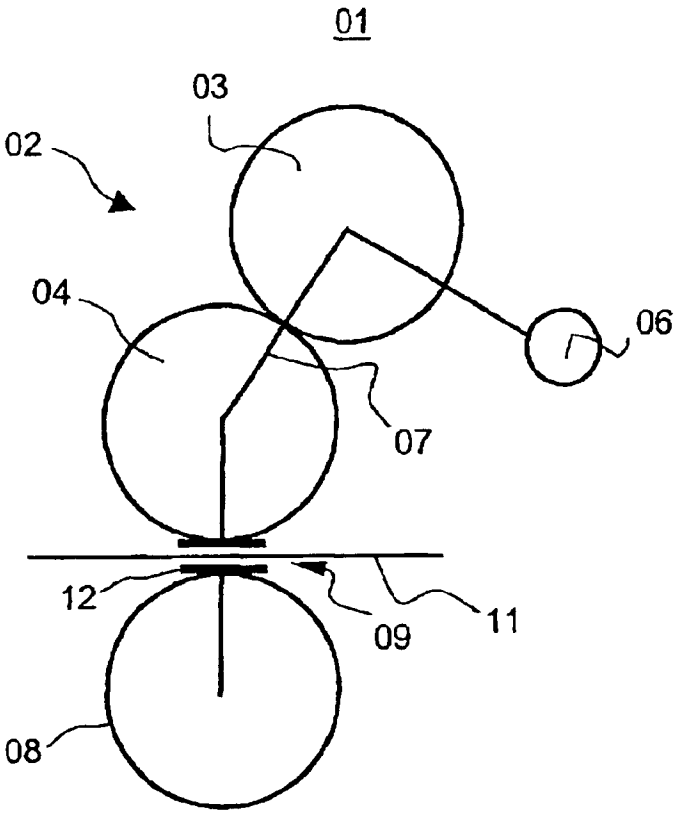
FIG. 1, a schematic representation of a side elevation view of a first preferred embodiment of a printing unit in accordance with the present invention, FIG. 2, a schematic representation of a side elevation view of a second preferred embodiment of a printing unit, FIG. 3, a schematic representation of a side elevation view of a third preferred embodiment of a printing unit as five-cylinder printing unit, FIG. 4, a schematic representation of a side elevation view of a fourth preferred embodiment of a printing unit as five-cylinder printing unit, FIG. 5, a schematic representation of a side elevation view of a fifth preferred embodiment of a printing unit as five-cylinder printing unit, FIG. 6, a schematic representation of a side elevation view of a sixth preferred embodiment of a printing unit as five-cylinder printing unit, FIG. 7, a schematic representation of a side elevation view of a seventh preferred embodiment of a printing unit as five-cylinder printing unit, FIG. 8, a schematic representation of a side elevation view of an eighth preferred embodiment of a printing unit as seven-cylinder printing unit, FIG. 9, a schematic representation of a side elevation view of a ninth preferred embodiment of a printing unit as seven-cylinder printing unit, FIG. 10, a schematic representation of a side elevation view of a tenth preferred embodiment of a printing unit as nine-cylinder printing unit, FIG. 11, a schematic representation of a side elevation view of an eleventh preferred embodiment of a printing unit as nine-cylinder printing unit, FIG. 12, a schematic representation of a side elevation view of a twelfth preferred embodiment of a printing unit as nine-cylinder printing unit, FIG. 13, a schematic representation of a side elevation view of a thirteenth preferred embodiment of a printing unit as nine-cylinder printing unit, FIG. 14, a schematic representation of a side elevation view of a fourteenth preferred embodiment of a printing unit as ten-cylinder printing unit, FIG. 15, a schematic representation of a side elevation view of a fifteenth preferred embodiment of a printing unit as ten-cylinder printing unit, FIG. 16, a schematic representation of a side elevation view of a sixteenth preferred embodiment of a printing unit as ten-cylinder printing unit, FIG. 17, a schematic representation of a side elevation view of a seventeenth preferred embodiment of a printing unit as ten-cylinder printing unit, FIG. 18, a schematic representation of a side elevation lateral view of an eighteenth preferred embodiment of a printing unit as ten-cylinder printing unit, FIG. 19, a schematic depiction of a first operational state for operating a five-cylinder printing unit in accordance with the fourth preferred embodiment, FIG. 20, a schematic depiction of a second operational state for operating a five-cylinder printing unit in accordance with the fourth preferred embodiment, FIG. 21, a schematic depiction of a third operational state for operating a five-cylinder printing unit in accordance with the fourth preferred embodiment, FIG. 22, a schematic depiction of a first operational state for operating a nine-cylinder printing unit in accordance with the tenth preferred embodiment, FIG. 23, a schematic depiction of a first operational state for operating a ten-cylinder printing unit, FIG. 24, a schematic depiction of a second operational state for operating a ten-cylinder printing unit, and in FIG. 25, a schematic depiction of a third operational state for operating a ten-cylinder printing unit in accordance with the present invention.

A printing unit 01 of a printing press, in particular a web-fed rotary printing press, as depicted in FIG. 1, has a first pair 02 of cooperating cylinders 03, 04, for example, a first forme cylinder 03 and a first transfer cylinder 04 cooperating with it. For all of the preferred embodiments to be described, the cooperating cylinder pair 02 can also be fixedly or switchably mechanically connected with an ink and/or damping unit, which is not specifically shown. The drive mechanism of the cooperating cylinder pair 02 is mechanically coupled and is provided by a common drive motor 06 during production. The first cylinder pair 02 and the drive motor 06 form a first drive assembly 07. The drive motor 06 either drives the forme cylinder 03, which drives the transfer cylinder 4 via a mechanical coupling, for example a positive coupling by the use of gear wheels, or drives the transfer cylinder 4 which drives the forme cylinder 03. However, both cylinders 03, 04 in the cooperating pair of cylinder 02 can also be indirectly driven via a motor pinion or a wheel chain, or via toothed belts and/or parallel from the direction of the drive motor 06. A drive assembly with a fixed coupling and with or without a motor is represented in the drawing by solid lines, which solid lines connect the axes of rotation of the respective cylinders, and possibly also the drive motor. A releasable coupling, which is not specifically represented in the drawings, can also be provided between the fixedly coupled cooperating cylinder pair 02 and the drive motor 06. No conclusions regarding the connected or disconnected state should be drawn from the schematic representations of FIGS. 1 to 18. In FIGS. 19 to 25, a transfer cylinder, if it is understood as being moved back from the cylinder 08, is at a distance from the cylinder 08. In FIGS. 1 to 18, a switchable coupling is generally represented by two lines, which two lines vertically interrupt a drive assembly. In FIGS. 19 to 25, this double line indicates a released coupling, and a heavy single line indicates an engaged coupling.

In the description which follows, a drive motor is understood to be a drive motor suitable for driving a printing unit under production conditions, and not an auxiliary motor only suitable for auxiliary functions.

Together with a third cylinder 08, for example a satellite cylinder 08, as seen in FIG. 1, the first transfer cylinder 04 constitutes a print location 09, where the two cylinders 04 and 08 act together in a print-on position via a web 11 running between the cylinders 04 and 08. For example, web 11 may be a web 11 of material to be imprinted or a paper web 11. In a print-on position, this third cylinder 08 serves as a backstop for the first transfer cylinder 04. The drive mechanisms of the first pair of cooperating cylinders 02 and the drive mechanism of the third or satellite cylinder 08 are connected with each other by a switchable mechanical coupling 12, for example by a switchable connector 12. The switchable connector 12 can be a unidirectional connector or a continuous connector, or a positive or a non-positive connector.

Figure 2:
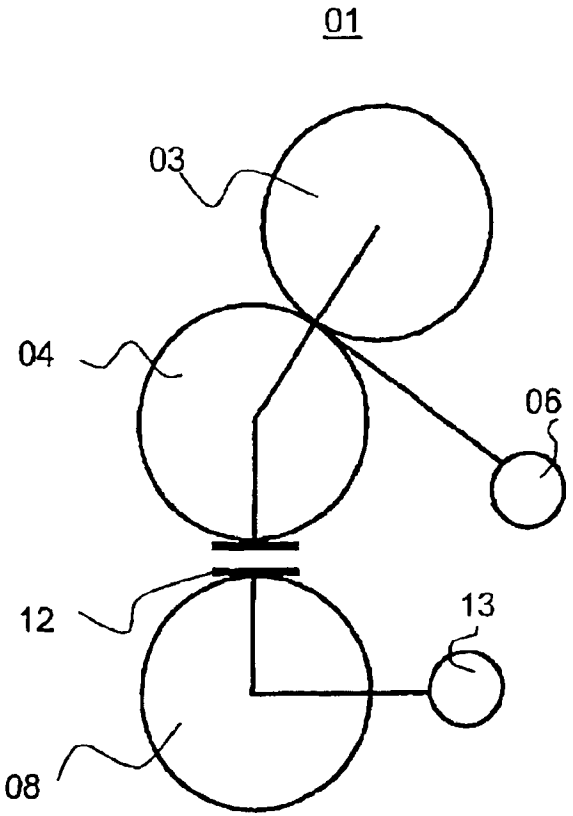

In preferred embodiments of a first three-cylinder group, as depicted in FIGS. 1 and 2, the third cylinder 08 is embodied as a satellite cylinder 08, in particular as a steel cylinder 08. Here, the printing unit 01 represents for example a three-cylinder color deck, or a part of a larger printing system. What was discussed above, applies to the options of configuring the first pair of cooperating cylinders 02.

In a first preferred embodiment, which is shown in FIG. 1, the steel cylinder 08 is embodied without its own drive mechanism. The drive motor 06 of the first pair of cooperating cylinders 02 drives the first forme cylinder 03, which drives the first transfer cylinder 04. In the subsequent FIGS. 2 to 17, the web 11 is not represented. The same reference numerals are also used again for recurring elements.

In the second preferred embodiment, as depicted in FIG. 2 the steel satellite cylinder 08 is provided with its own drive motor 13, which drives the steel cylinder 08 during production. The drive motor 06 here drives both cylinders 03, 04, for example by use of a train of gear wheels.

In a second group of preferred embodiments, which are shown in FIGS. 3 to 7, the third cylinder 08, which cooperates with the first cylinder pair 02, is embodied as a satellite cylinder, which also cooperates with a second pair of cooperating cylinders 14 consisting of a cylinder 16, consisting of, for example, a second transfer cylinder 16, and a cylinder 17, for example a second forme cylinder 17. A second print location 18 is defined between the satellite cylinder 08 and the second transfer cylinder 16. The satellite cylinder 08 can be coupled mechanically fixedly, or switchably, with the second cylinder pair 14, and in particular with the second transfer cylinder 16. However, the satellite cylinder can also be embodied without being mechanically coupled with the second cylinder pair 14. Together with the two cylinder pairs 02, 14, the satellite cylinder 08 forms a five-cylinder printing unit 19.

The second transfer cylinder 16 and the second forme cylinder 17 of the second pair of cooperating cylinders 14 can be coupled mechanically fixedly, or switchably, with each other. In special cases, a mechanical coupling of the two cylinders 16, 17 can also be omitted. They can be driven by a drive motor 21 on one of the two cylinders 16, 17, or on both cylinders 16, 17. The driving by the drive motor 21 at the second cylinder pair 14 can also be omitted.

Figure 3:
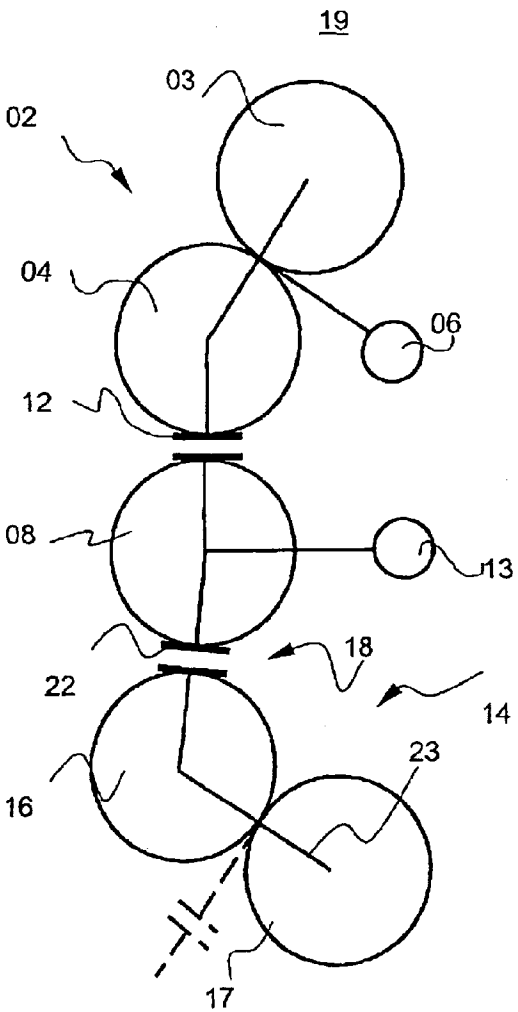

In the third preferred embodiment depicted in FIG. 3, the satellite cylinder 08 is connected via a second, switchable mechanical coupling 22, for example a connector 22, with the second cylinder pair 14. The drive and coupling configuration of the second cylinder pair 14, which is connected with the satellite cylinder 08, can be variously embodied, as explained above. In FIG. 3 the second cylinder pair 14 has a fixedly coupled drive assembly 23, but is provided without its own drive motor. As indicated in dashed lines, the drive assembly 23 for the second cylinder pair 14 can also be switchably coupled with another drive assembly. The satellite cylinder 08 has the drive motor 13, for example.

Figure 4:
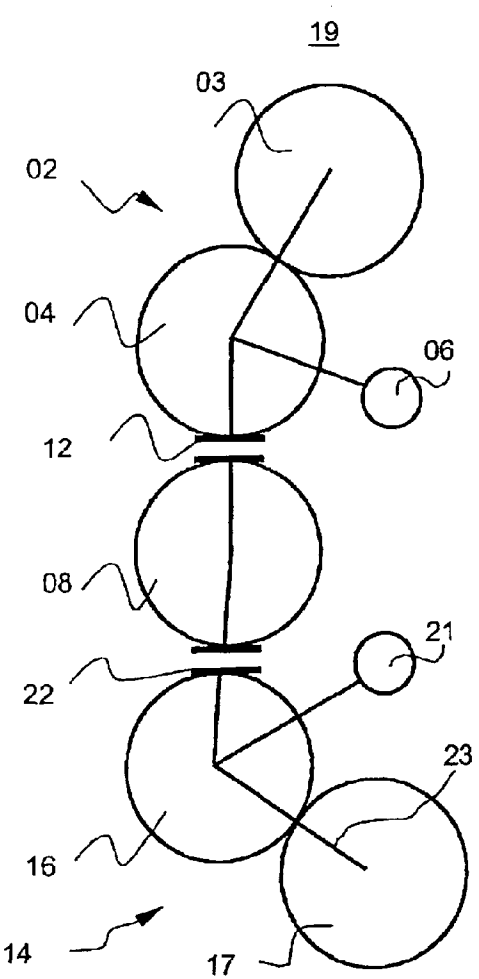

The fourth preferred embodiment which is shown in FIG. 4, represents a particularly advantageous variable five-cylinder printing unit 19 because it is particularly flexible. Again, the satellite cylinder 08 is connected with the second cylinder pair 14 by the switchable mechanical coupling 22. The second cylinder pair 14 has the fixedly coupled drive assembly 23, in which a drive motor 21 drives the second transfer cylinder 18, which, in turn, drives the second forme cylinder 17. The driving of the second cylinder pair 14 can also take place at the second forme cylinder 17, or through a gear, not represented, by the drive assembly 23.

Figure 5:
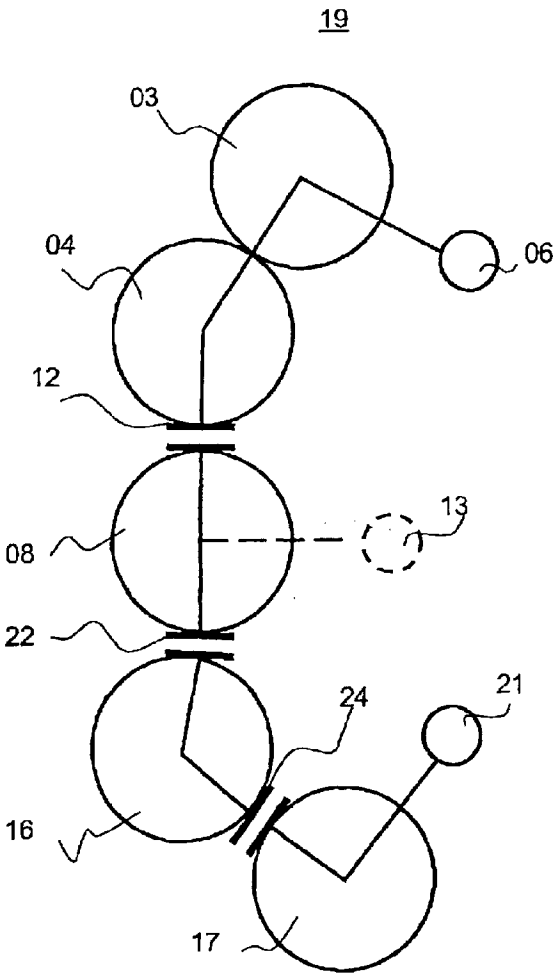

In contrast to FIG. 4, in the fifth preferred embodiment, which is shown in FIG. 5, the second transfer cylinder 16 and the second forme cylinder 17 are mechanically connected with each other by a third switchable mechanical coupling, for example a connector 24. In this example, the second forme cylinder 17 has the drive motor 21. However, the drive motor 21 can also be arranged on the second transfer cylinder 16, or on both cylinders 16, 17. Alternatively, or additionally to this, the satellite cylinder 08 can be embodied with the drive motor 13, as depicted in dashed lines in FIG. 5.

Figure 6:
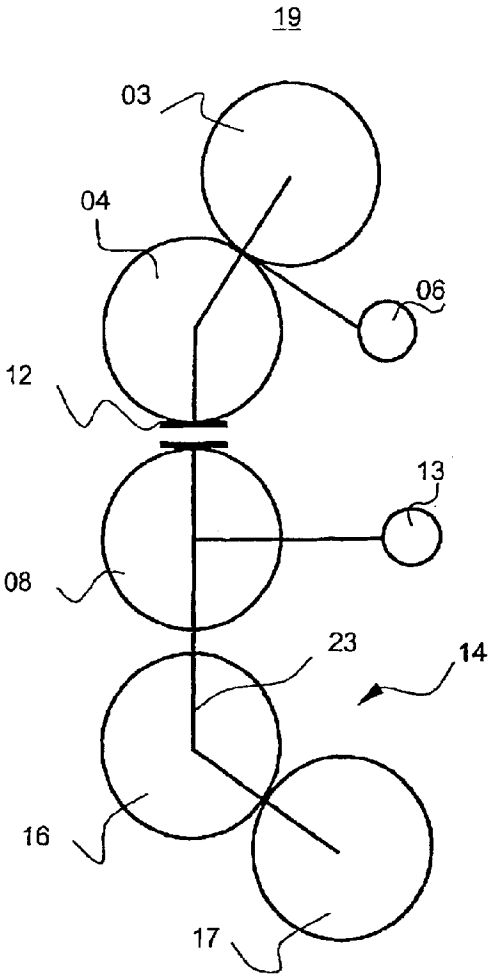

In a sixth preferred embodiment, which is shown in FIG. 6, the satellite cylinder 08, together with the second cylinder pair 14, constitutes the fixed, non-switchable drive assembly 23. This drive assembly 23 can have one or several drive motors 21, 13. In the depicted configuration , only the satellite cylinder 08 has the drive motor 13, which also drives both cylinders 16, 17 of the second pair of cooperating cylinders 14.

Figure 7:
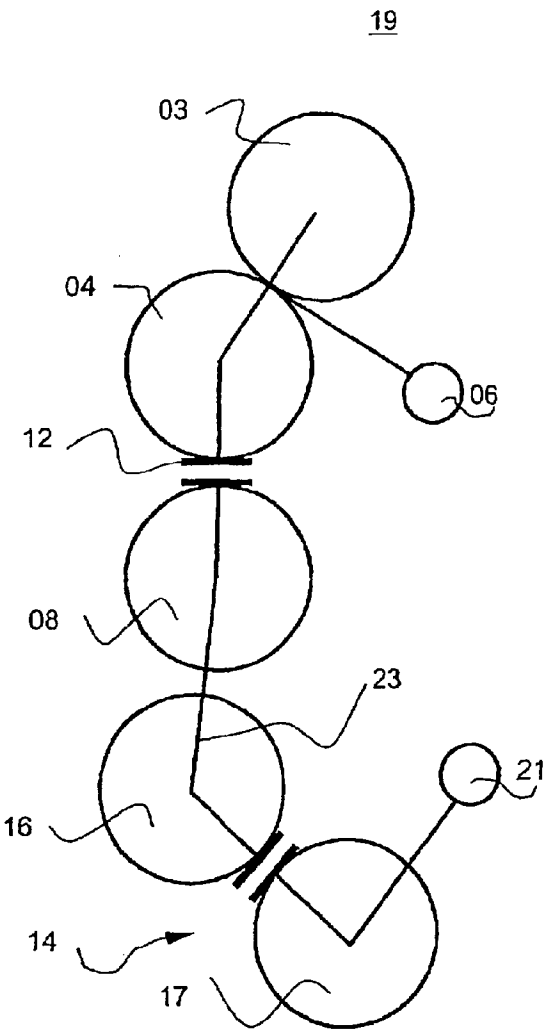

In a seventh preferred embodiment, as shown in FIG. 7, the satellite cylinder 08, together with the second transfer cylinder 16 of the second cylinder pair 14, constitutes the fixed, non-switchable drive assembly 23. In this embodiment, the second forme cylinder 17 has the drive motor 21. The drive assembly 23 consisting of the satellite cylinder 08 and the transfer cylinder 16 does not have its own drive motor. However, the drive assembly 23 can also have a drive motor 21 at the second transfer cylinder 16, or can have a drive motor 13 at the satellite cylinder 08, or a drive motor 13, 21, which drives both cylinders 08, 16 via a gear. In that case, the drive motor 21 at the second forme cylinder 17 can possibly be omitted.

Figure 8:
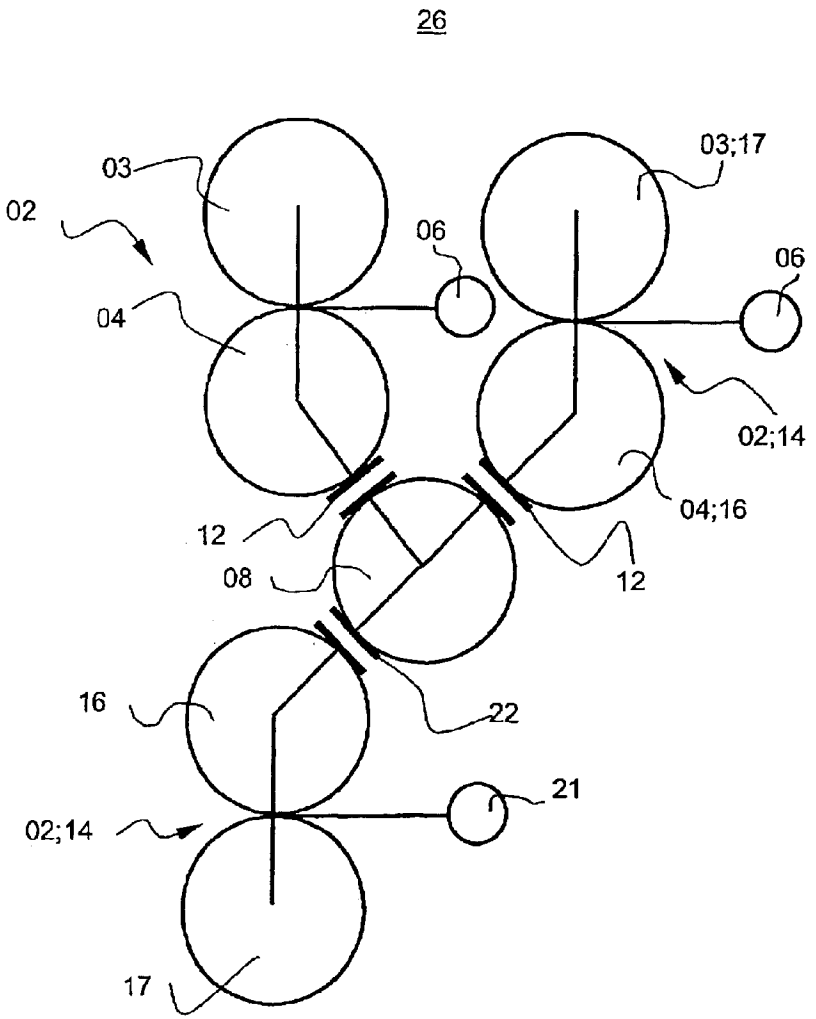
Figure 9:
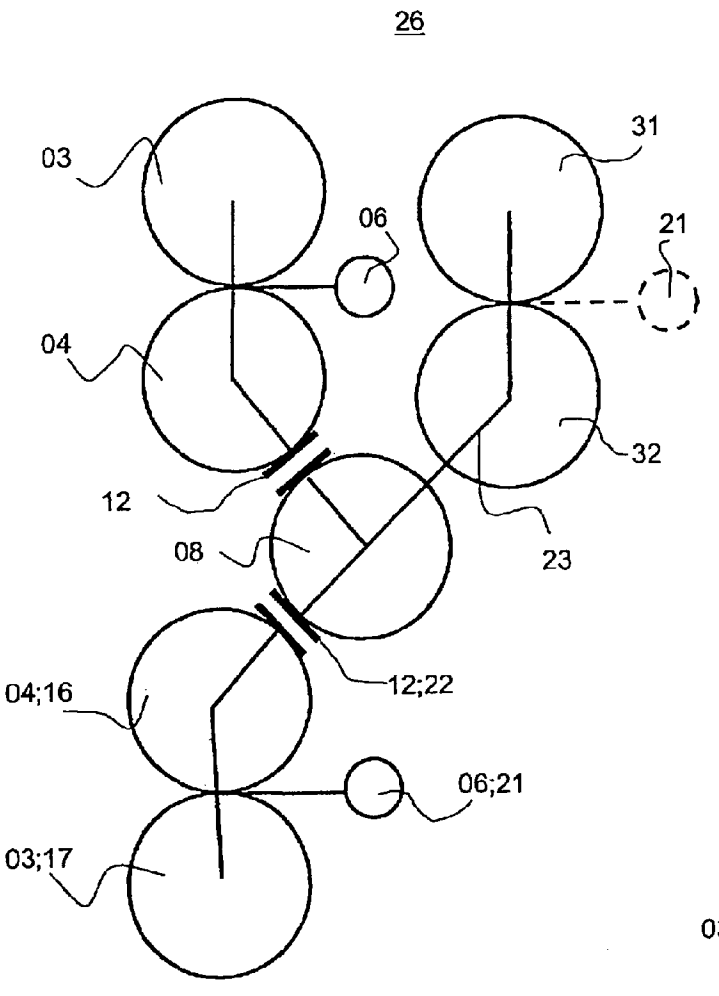

In an advantageous further development of the present invention, the printing units consisting of the first pair of cooperating cylinders 02, with its drive motor 06, and the switchable mechanical coupling or connector 12 of the first seven preferred embodiments constitute basic configurations, which can be standardized for a flexible configuration of larger cylinder groups, such as seven-cylinder printing units 26 in Y or lambda format as shown in FIGS. 8 and 9, nine-cylinder printing units 27, as shown in FIGS. 10-13 or ten-cylinder printing units 28, embodied as semi-satellite or satellite units, as shown in FIGS. 14-18.

FIG. 8 shows, in the eighth preferred embodiment, a seven-cylinder printing unit 26, wherein a third pair of cooperating cylinders 02, 14, consisting of transfer cylinders 04, 16 and forme cylinders 03, 17 and provided with a drive motor 06, can be placed against the satellite cylinder 08 in accordance with the example in FIG. 4.

As represented in the ninth preferred embodiment of FIG. 9, the third pair of cooperating cylinders 29 can also form the fixed drive assembly 23 with the satellite cylinder 08. This drive assembly 23 can be embodied without or with its own drive motor 13, 12, as shown in dashed lines.

The drive assembly 23 advantageously does not have its own drive motor, but instead is driven by one or by both drive motors 06 via the connectors 12, 22.

Figure 10:
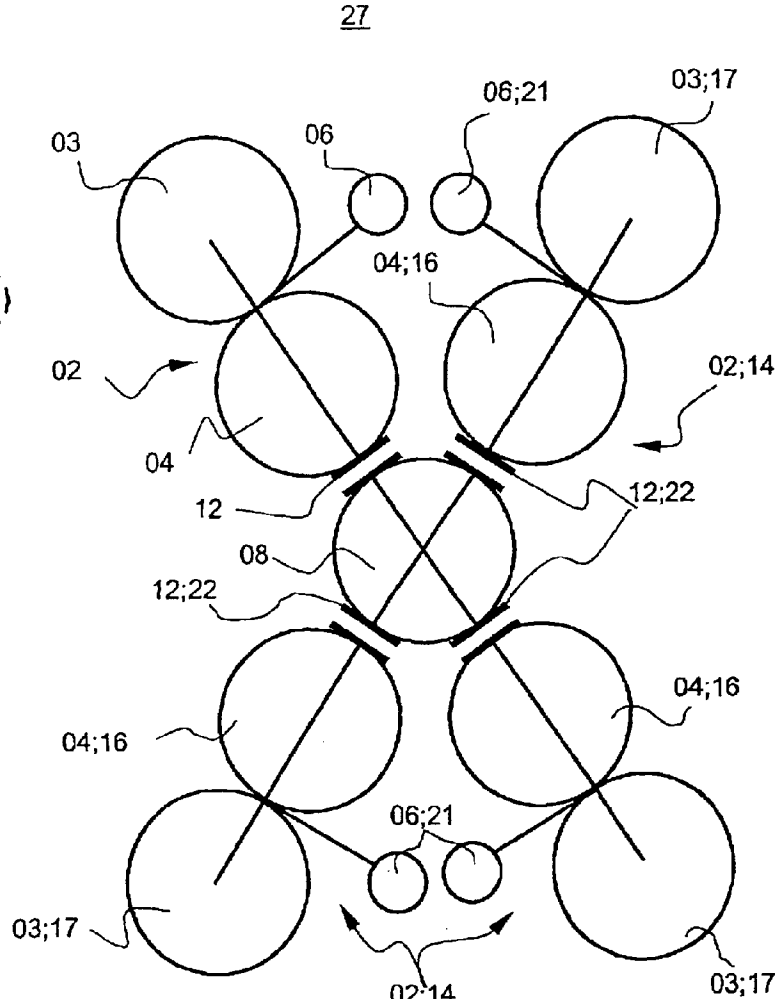

In the tenth preferred embodiment, as depicted in FIG. 10 there is provided a symmetrical nine-cylinder printing unit 27 or satellite unit, with four mechanically fixedly coupled cylinder pairs 02, 14, and respectively one drive motor 06, 21, which are switchably coupled via four switchable connectors 12, 22 with the satellite cylinder 08. However, depending on the requirements, it is also possible to make variations, wherein only one, two or three cylinder pairs 02 are coupled with the satellite cylinder 08 via a connector 12, 22.

Figure 11:
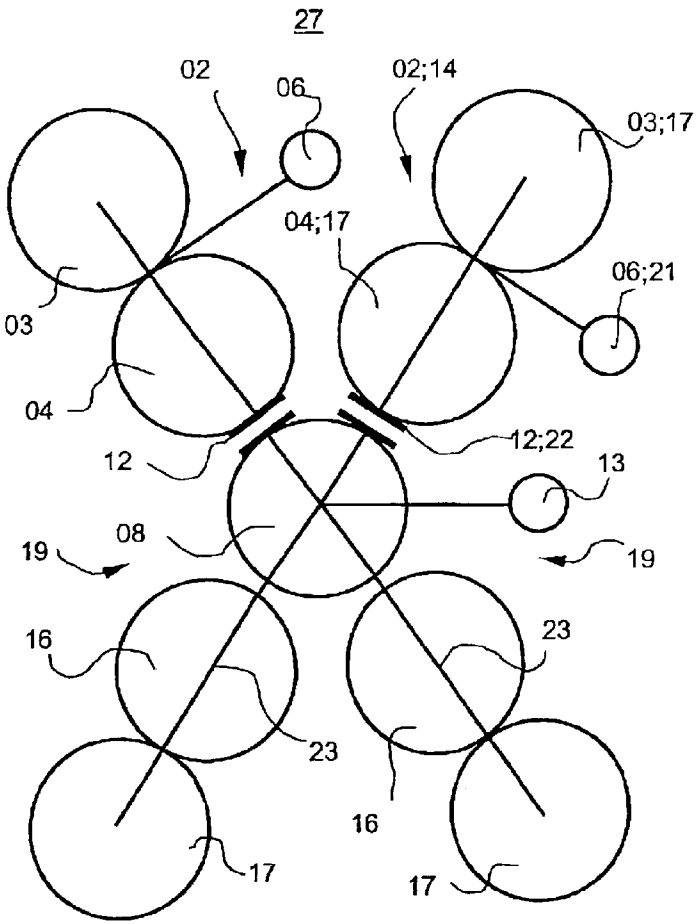

FIG. 11, in the eleventh preferred embodiment, shows a nine-cylinder printing unit 27, wherein two cylinder pairs 02, arranged above the satellite cylinder 08, are switchably connected with the satellite cylinder 08. The two forme cylinders 17 and the transfer cylinder 16, arranged underneath each, together with the satellite cylinder 08 each constitute a drive assembly 23, which can be driven by a drive motor 13 that is arranged at the satellite cylinder. For example, two printing units 01 from the first two preferred embodiments, as well as vertically arranged five-cylinder printing units 19 in accordance with the sixth preferred embodiment, can be seen here. Depending on the requirements, for example with a horizontally guided web 11, a five-cylinder printing unit 19 can also be formed from two pairs 02, 14 located next to each other.

Figure 12:
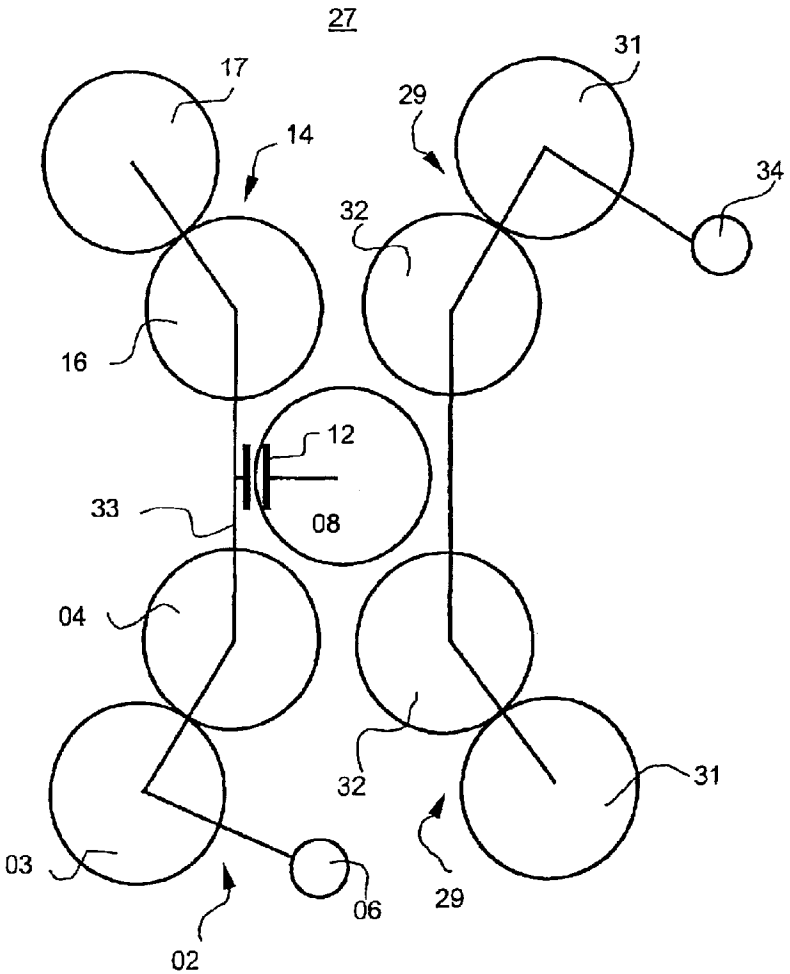

In a twelfth preferred embodiment, as shown in FIG. 12, one of the two cylinder pairs 02 arranged underneath the satellite cylinder 08 of a nine-cylinder printing unit 27, or satellite unit, is driven by a drive motor 06 at the forme cylinder 03, which then drives the transfer cylinder 04. The transfer cylinder 04 drives, on the one hand, the transfer cylinder 16 of the fixedly coupled cylinder pair 14, and also drives the satellite cylinder 08 via a switchable connector 12. The cylinder pair 02 can be connected via the switchable connector 12 with the satellite cylinder 08 and is fixedly mechanically coupled with the cylinder pair 14 located above it. Together with the drive motor 06, the two cylinder pairs 02, 14 constitute a drive assembly 33. In the depicted example, two further cylinder pairs 29, each consisting of respectively a cylinder 31, for example a forme cylinder 31, and a cylinder 32, for example a transfer cylinder 32, are fixedly coupled with each other and can be driven by a single further drive motor 34 which is arranged at the upper forme cylinder 31.

Figure 13:
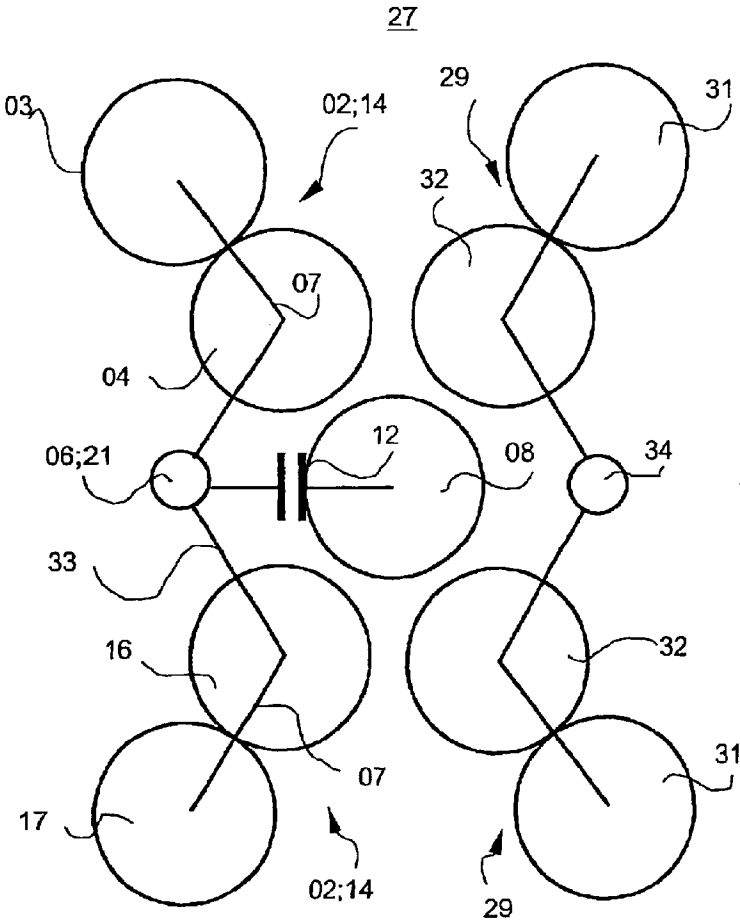

FIG. 13 shows the arrangement of the drive motor 06 for the cylinder pair 02 in such a way that again both cylinder pairs 02, 14, which are arranged above each other, can be driven by the one drive motor 06, 21 and are fixedly connected with each other. Together with the drive motor 06, 21, the two cylinder pairs 02, 14 constitute the drive assembly 33. The drive motor 06, 21 respectively drives the transfer cylinder 04, 16 of each of the fixedly coupled cylinder pairs 02, 14, which transfer cylinders 04, 16 drives the associated forme cylinder 03, 17, respectively. The drive assembly 07 consisting of the forme cylinder 03, 07, transfer cylinder 04, 18 and the drive motor 06, 21 can be mechanically coupled, via the connector 12, with the satellite cylinder 08. The two remaining cylinder pairs 29 are each mechanically coupled in pairs, wherein both cylinder pairs 29 can be driven by only the one drive motor 34 at the respective transfer cylinder 32, which drives the forme cylinder 31.

Figure 14:
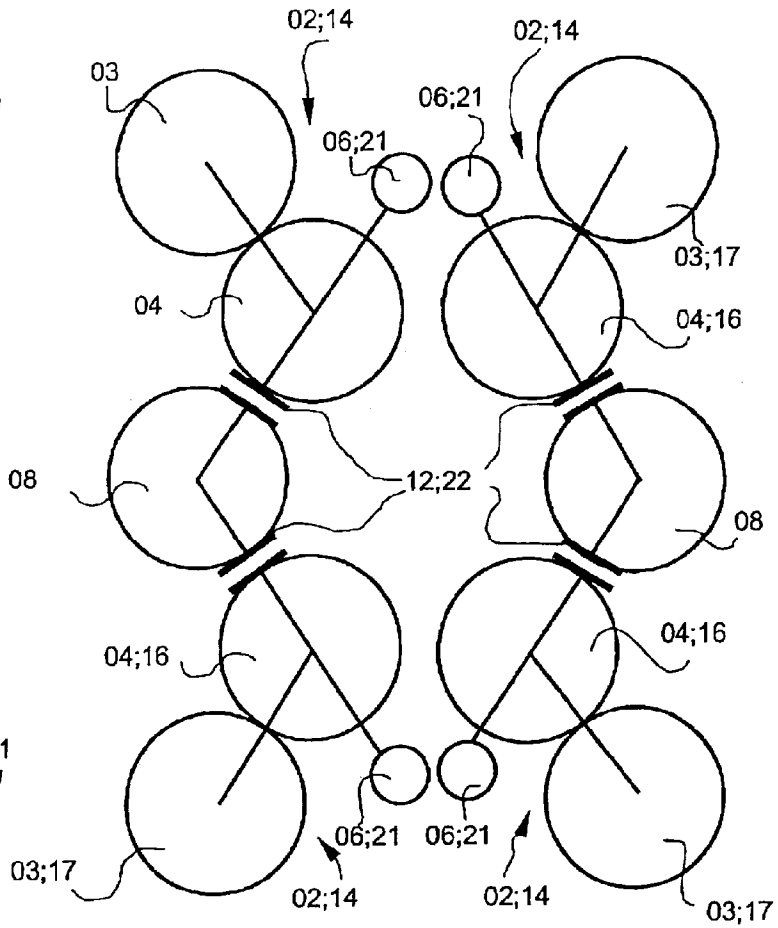

In a fourteenth preferred embodiment, FIG. 14 shows a ten-cylinder printing unit 28, which has four cylinder pairs 02, or 14, which are driven in pairs at the respective transfer cylinder 04, or 16, by the drive motor 06, or 21. In the depicted example, respectively two cylinder pairs 02, 14 arranged on top of each, other are switchably mechanically connected with the cooperating satellite cylinder 08, each via respective connectors 12, 22.

Figure 15:
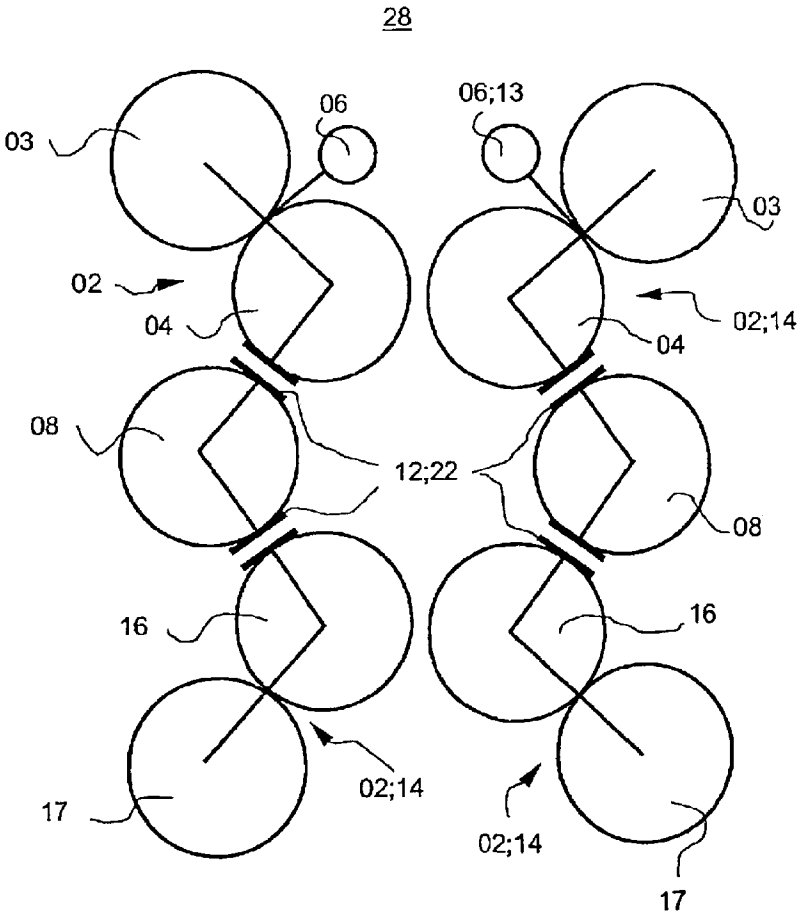

The two cylinder pairs 02, 16 from FIG. 14, which are respectively arranged underneath the associated satellite cylinder 08, however, can be embodied without their own drive motor, as represented in FIG. 15. The two satellite cylinders 08 in FIG. 15 can also be mechanically coupled with each other and can have a common drive motor 13 driving both satellite cylinders 08.

Figure 16:
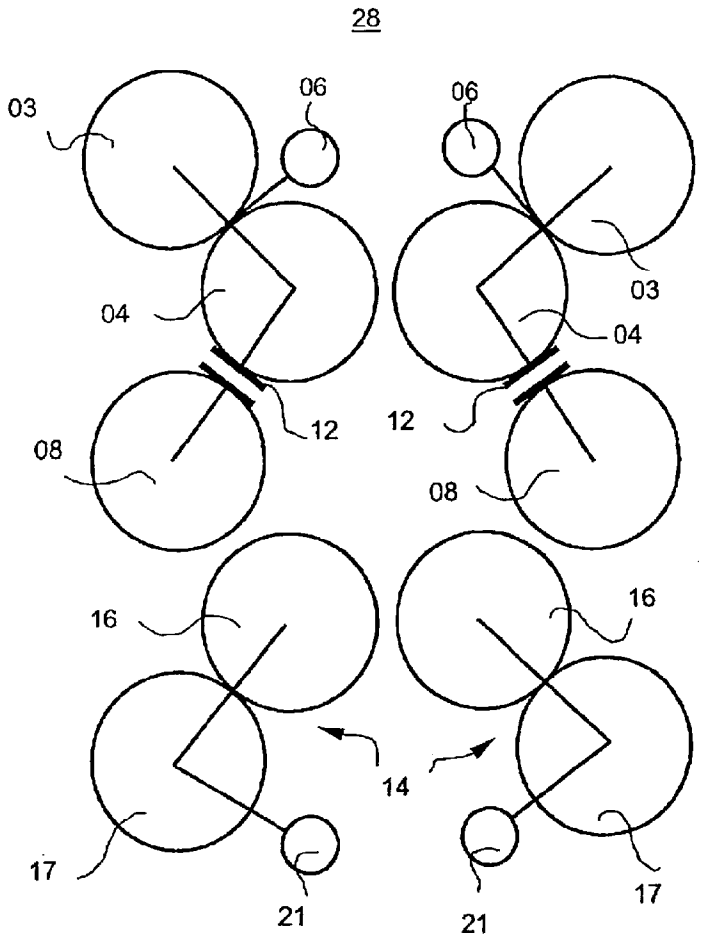

Also based on FIG. 14, in the sixteenth preferred embodiment shown in FIG. 16, the cylinder pairs 14, arranged underneath the satellite cylinders 08, are not mechanically coupled, and cannot be coupled, with the associated satellite cylinder 08. There, the driving of each cylinder pair 14 takes place by operation of a drive motor 21 positioned at the forme cylinder 17 of each cylinder pair 14.

Figure 17:
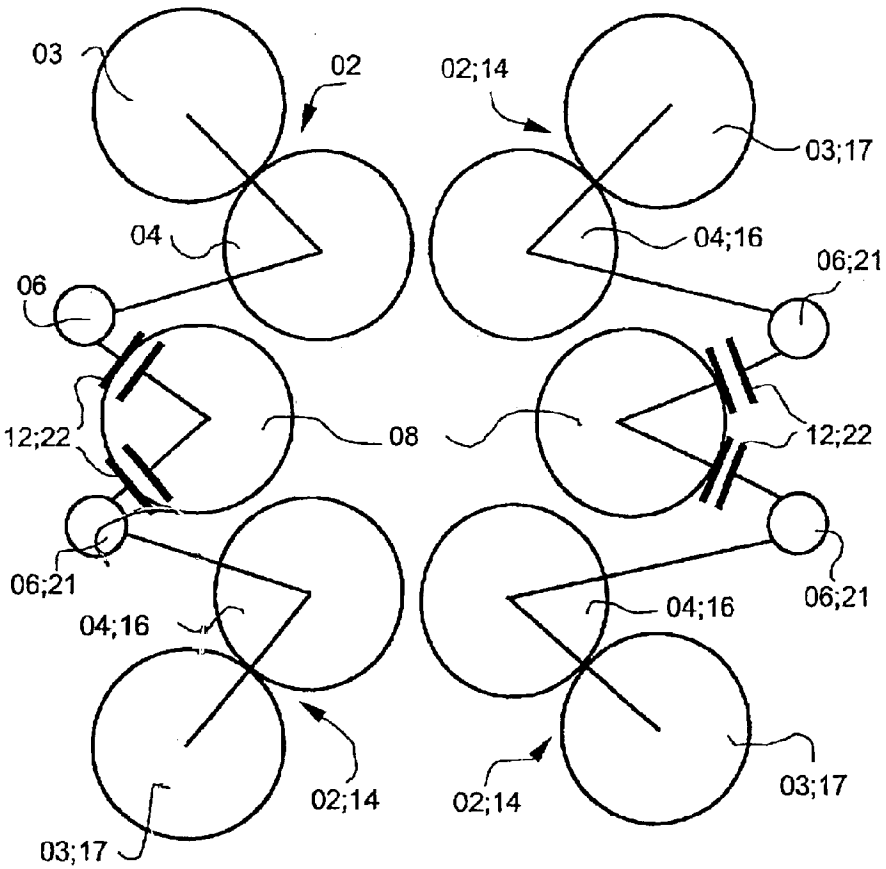

The seventeenth preferred embodiment, which is depicted in FIG. 17, represents the preferred fourteenth embodiment in a representation which is modified for the seventeenth embodiment. Each cylinder pair 02, 14 is driven by its own drive motor 06, 21, wherein each drive motor 06, 21 additionally selectively drives the satellite cylinder 08 cooperating with the respective pair 02, 14 via a switchable connector 12, 21.

Figure 18:
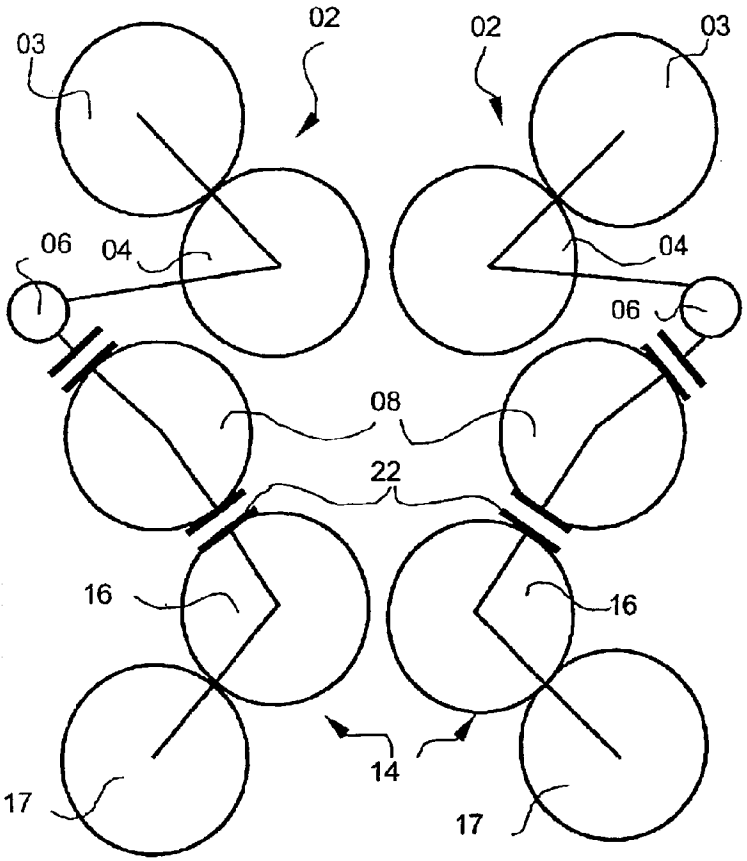

In an eighteenth preferred embodiment, as seen in FIG. 18, the two upper cylinder pairs 02 have a drive mechanism in accordance with the seventeenth preferred embodiment. The cylinder pairs 14 located below the satellite cylinders do not have their own drive motor. Instead, they can be coupled via the connectors 22 to the drive mechanism of the respectively associated satellite cylinder 08.

The configurations consisting of drive motors 06, 13, 21 and of connectors 12, 22, 24, as schematically represented in FIGS. 1 to 18, can be realized in different ways. For example, the driving of a cylinder can take place directly from the rotor of a motor to a journal of one of the cylinders 03, 04, 08, 16, 17 via shafts, via pinion gears with or without wheel chains, via toothed belts or also via friction gears. Also, the coupling-in or coupling-out of the cylinders or cylinder groups can take place in that gear wheels, which are arranged, fixed against relative rotation, on the journals of the cylinders, can be displaced axially in respect to each other and in this way can be brought into or out of engagement. This last mentioned case should also be understood, in the sense of the present invention, as constituting a connector 12, 22, 24.

Each one of the drive configurations schematically represented in FIGS. 1 to 18 can be realized in different ways. For example, for switchably coupling two cylinders 03, 04, 08, 16, 17 with each other, for example for coupling the transfer cylinder 04 and the satellite cylinder 08, in a first case, a first gear wheel can be seated, fixed against relative rotation, on a journal of the transfer cylinder 04, and a second gear wheel, which is in engagement with the first gear wheel, can be rotatably seated on a journal of the satellite cylinder 08. The second gear wheel on the journal of the satellite cylinder 08 can be selectively fixed in place by the use of a connector 12, also seated, fixed against relative rotation, on a journal of the satellite cylinder 08. In a second case, the arrangement of the fixedly and rotatably seated gear wheels can be reversed.

In the same way as shown by the schematic representations in FIGS. 14 and 17, or 15 and 18, respectively two options for coupling the cylinder pair 02, 14 to the satellite could be provided. In FIG. 14, or 15, the drive motor 06, 21 directly drives, for example via a pinion gear, a gear wheel arranged on the journal of the transfer cylinder 04, which gear wheel drives a gear wheel of the satellite cylinder 08, wherein one of the gear wheels is embodied fixed against relative rotation, and the other gear wheel is rotatable, but is selectively fixable in place. In an advantageous embodiment, a rotatable gear wheel, which can be selectively fixed in place via the connector 12, 22, can be arranged on the journal of the satellite cylinder 08 and is driven via a pinion gear by the drive motor 06. This, in turn, drives a gear wheel that is arranged, fixed against relative rotation, on the transfer cylinder 04, 16. With the connector 12, 22 released, the drive motor 06, 21 drives the pair 02, 14. With the connector 12, 22 engaged, it drives the pair 02, 14 and the satellite cylinder 08 all as seen in FIG. 17 or 18, respectively.

A multitude of operational states can be realized by usage of the described variations, which number of operational states can be expanded by combination. Only a few of these operational states will be mentioned by way of example in what follows:

In the printing unit 01 which is provided with only one drive motor 06 arranged on the cylinder pair 02 and with the connector 12 released and in a print-off position, i.e. in which the transfer cylinder 04 is not placed against the satellite cylinder 08, rotation of the cylinders 03, 04 can take place without the satellite cylinder 08 being moved. A possibly already drawn in web 11 can be maintained stationary, along with the satellite cylinder 08, all as shown in FIG. 1.

If the satellite cylinder 08 also has a drive motor 13, and with the connector 12 released, a rotation of the satellite cylinder 08 independently of the pair 02, and therefore the continued conveying of the web 11, is possible without the pair 02 rotating along. A relative change of the angle of rotation position between the cylinder pair 02 and the satellite cylinder 08 is also possible. But with the connector 12 engaged, in the latter case and in the print-on position, dependability is provided by the full redundancy of the two drive motors 06 and 13, which can both run during production, thus providing a so-called "full back-up". By reducing the drive output of the drive motors 06, 13 in steps, for example from 60% to 40% of the required total output, an inexact drive, because of possibly present play in the gear wheels or the gears, i.e. a possibly occurring tooth flank change, can also be prevented. Moreover, there is the option of a mechanical and/or electronic synchronization of the pair 02 and of the satellite cylinder 08.

For five-cylinder printing units 19 with five cylinders 03, 04, 08, 16, 17, further operational states result beyond the options already mentioned for the smaller printing units 01. Advantageous operational states are schematically represented in the FIGS. 19 to 21 by utilization means of the embodiment in accordance with FIG. 4.

In the present preferred embodiment, at least one of the two transfer cylinders 04 or 16 from the fourth preferred embodiment depicted in FIG. 4 is seated in such a way that it can take up at least three positions: a print-on position against the satellite cylinder 08, a print-on position against the respectively other transfer cylinder 16 or 04, and a print-off position, in which the respective transfer cylinder 04 or 16 does not cooperate with any of the other two cylinders 16 or 04 and 08. A seating of one of the two transfer cylinders 04 or 16 is advantageous, wherein it can take up five positions, in which a print-off position at the satellite cylinder 08 and at the other transfer cylinders 16 or 04, as well as a further print-off position, for example for changing the rubber blanket, is added to the above-mentioned two print-on positions. In this way, in the latter case it is possible to keep the pivot movements for the simple print-on or print-off position, without a simultaneous change of the print location, of a reversing or a rubber blanket cylinder, considerably smaller. In the drawings, the respective transfer cylinders 04 or 16 are only shown in the first three mentioned positions for the sake of simplicity.

Figure 20:
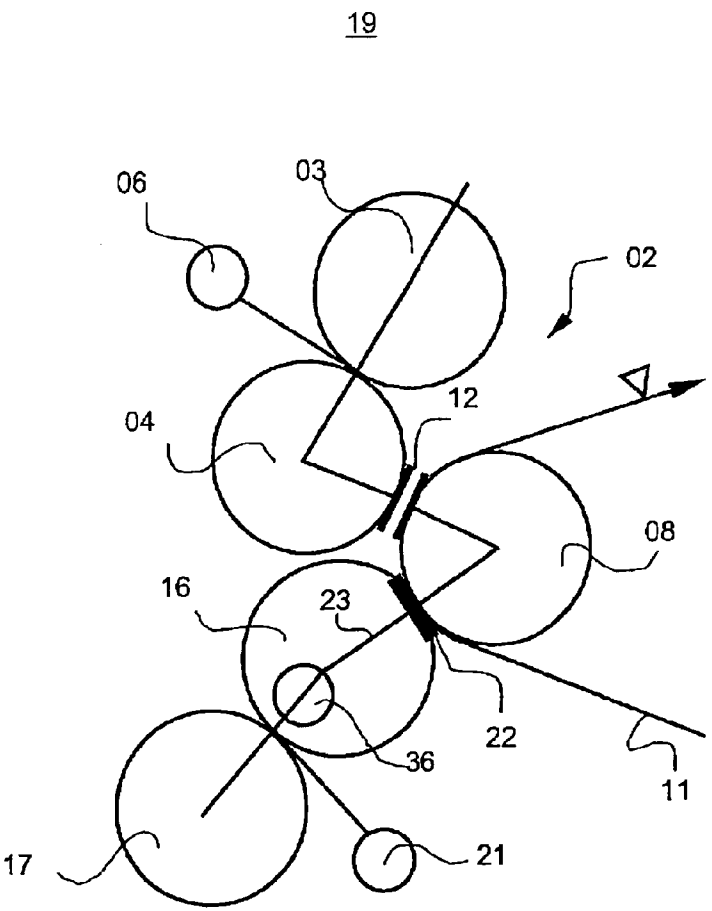
Figure 19:
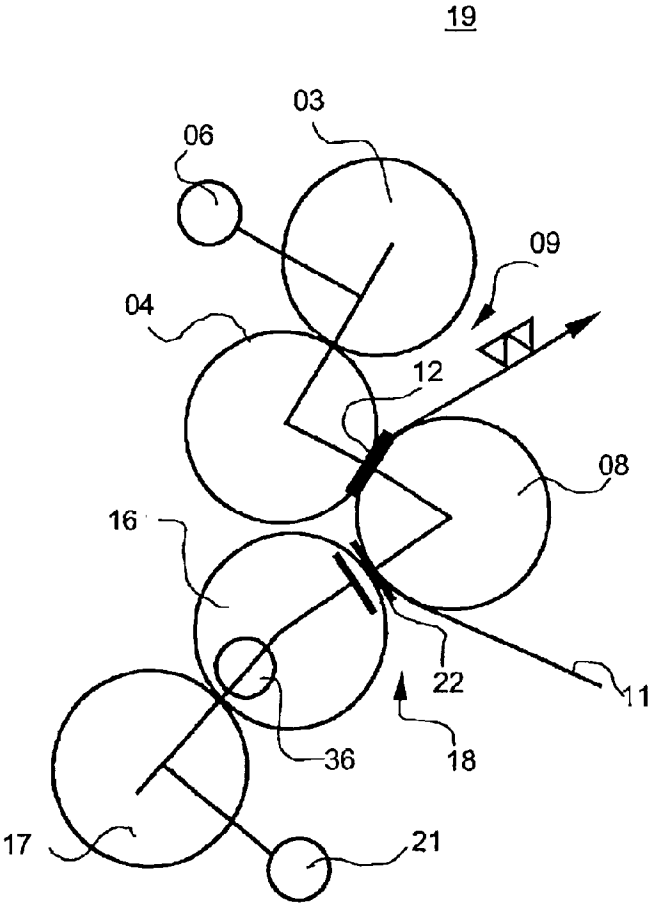
Figure 21:
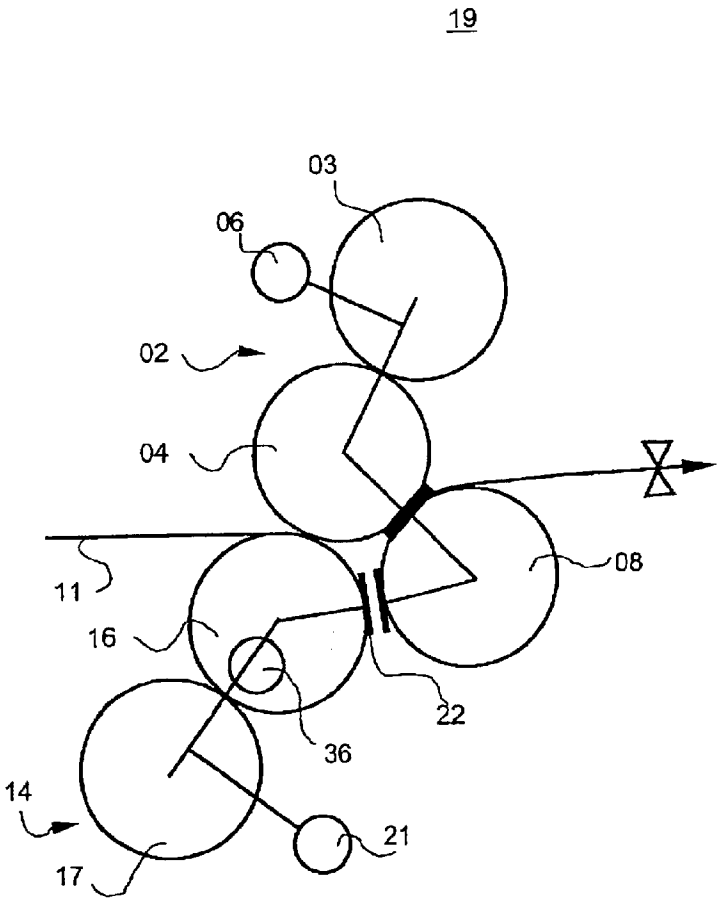

FIG. 19 shows the five-cylinder printing unit 19 configured corresponding to the preferred embodiment shown in FIG. 4, wherein for example the transfer cylinder 16 can be brought into the at least three previously mentioned different positions, which is schematically indicated in FIGS. 19 to 21 by use of an eccentrically arranged bearing ring 36. The seating can be embodied as an eccentric two-ring or an eccentric three ring seating, by a double eccentric seating, as a linear guide or a bearing conducted on a curved track or in any other way. It should only be necessary to bring the other transfer cylinder 04 into the two positions, print-on against the satellite cylinder 08, and print-off, away from the satellite cylinder 08. To make a clear distinction in the drawings, a cylinder 03, 04, 08, 16, 17 which can be placed in this way has not been separately indicated.

In FIG. 19, both transfer cylinders 04, 16 are placed against the satellite cylinder 08 and print on the web 11 at the two print locations 09, 18 doubly on one side of the web, for example in two colors, as represented by one inverted triangle for each imprintin a so-called rubber-against-steel operation. In this case, both connectors 12 and 22, or one of the two connectors 12, 22 can be closed, since all three cooperating cylinders 04, 08, 16 have the same direction of rotation. Also, as shown in FIG. 19, both drive motors 06, 21 can form a drive assembly 23 or 07, consisting of two cylinders 16 and 17 or of three cylinders 03, 04, 08, or vice versa, respectively, wherein the connector 12 is closed and the connector 22 open. Both drive motors 06 and 21 can also each drive all five cylinders 03, 04, 08, 16, 17 if both connectors 12 and 22 are closed.

In FIG. 20, the second transfer cylinder 16 continues to be in the print-on position with the connector 12 closed. The transfer cylinder 04 is in the print-off position, the connector 22 is released. While the drive motor 21, together with the forme cylinder 17 and the transfer cylinder 16 forms the drive assembly 23, the forme cylinder 03 and the transfer cylinder 04 of the first cylinder pair 02 can be independently rotated, for example for a plate change, or can be stopped and accelerated again. This similarly applies, in reverse, in case of a plate change at the forme cylinder 17, when the connector 22 is now opened and the connector 12 is now closed. A reversal of the running direction of the web 11 is also possible by reversing the directions of rotation.

In FIG. 21, the transfer cylinder 16, which can be brought into three or five positions, is in the print-on position against the transfer cylinder 04,during a so-called rubber-against-rubber operation. In an advantageous manner, the transfer cylinder 04 can furthermore be placed against the satellite cylinder 08. In this mode of operation, the web 11 runs between the two transfer cylinders 04, 16 and is imprinted singly on both sides. The reversal of the direction of rotation of the cylinder pair 14 required for this mode of operation demands the release of the connector 22 and therefore a drive of the second cylinder pair 14 by the drive motor 21 which is at least independent of the first pair 02. With only two drive motors 06, 21, a five-cylinder printing unit 19 configured in this way also meets the most varied requirements regarding the guidance of the web 11, the flying plate or rubber blanket change and the possibility of a reversal, even without the employment of elaborate individual drive motors.

For larger cylinder groups or units, such as seven-cylinder printing units 26, nine-cylinder printing units 27, and ten-cylinder printing units 28, corresponding functions and operational states can be integrated. A seven-cylinder printing unit 26 with three cylinder pairs 02, 14 in an embodiment in accordance with FIG. 9, with a total of only two drive motors, can be flexibly employed, for example for 3/0 printing, flying plate change, or in the imprinting function during 2/0 printing. If one of the transfer cylinders 04, 16 is provided with a pivotable seating, for example the bearing ring 36, 2/1 printing and an imprinting function during 2/0 printing also becomes possible.

In what follows, the variety of the operating mode, simultaneously along with a small number of drive motors, will be explained by use of respective preferred embodiments of a nine-cylinder printing unit 27 and of a ten-cylinder printing unit 28.

Figure 22:
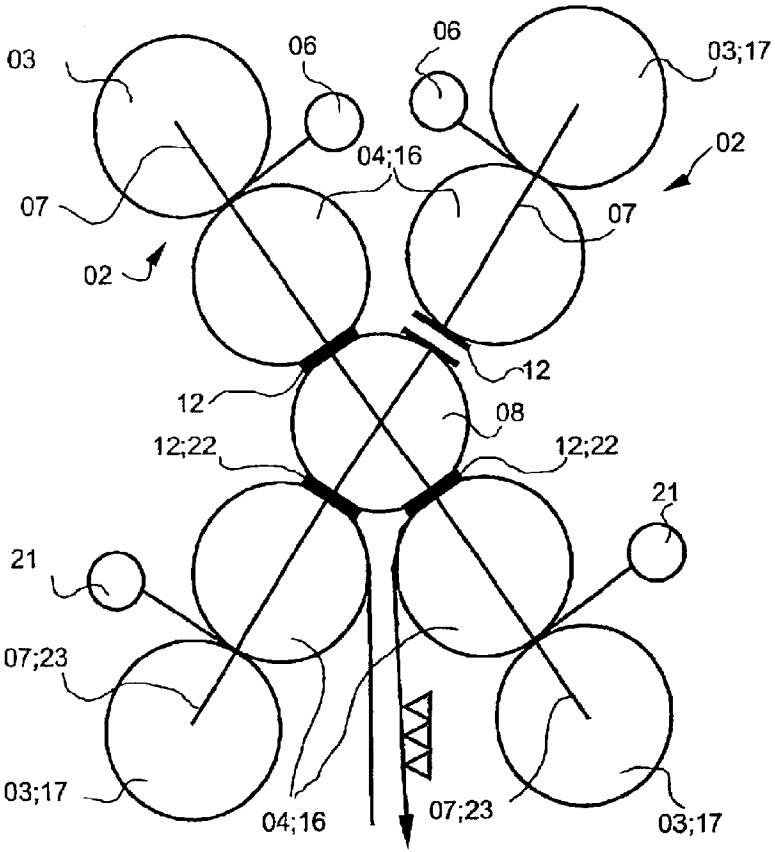

The nine-cylinder printing unit 27 shown in FIG. 22 has an imprinter functionality. For example, one of the upper cylinder pairs 02 is in a pivoted-away position with the connector 12 open, while the second of the upper cylinder pairs 02 is placed into contact and performs the instantaneous printing, for example. The pivoted-away cylinder pair 02 can be refitted. In the course of a flying change of the imprint, the pivoted-away cylinder pair 02 is accelerated to the required circumferential speed by operation of the drive motor 06 and can be coupled, as required, by the connector 12 with the satellite cylinder 08, while the cylinder pair 02 previously in contact is taken off the satellite cylinder 08 and is braked. In this example, the satellite cylinder 08 does not have its own drive motor and by use of the connectors 12, 22 is coupled into one or several drive assemblies 07, 23 in response to the required direction of rotation by use of the connectors 12, 22.

Figure 23:
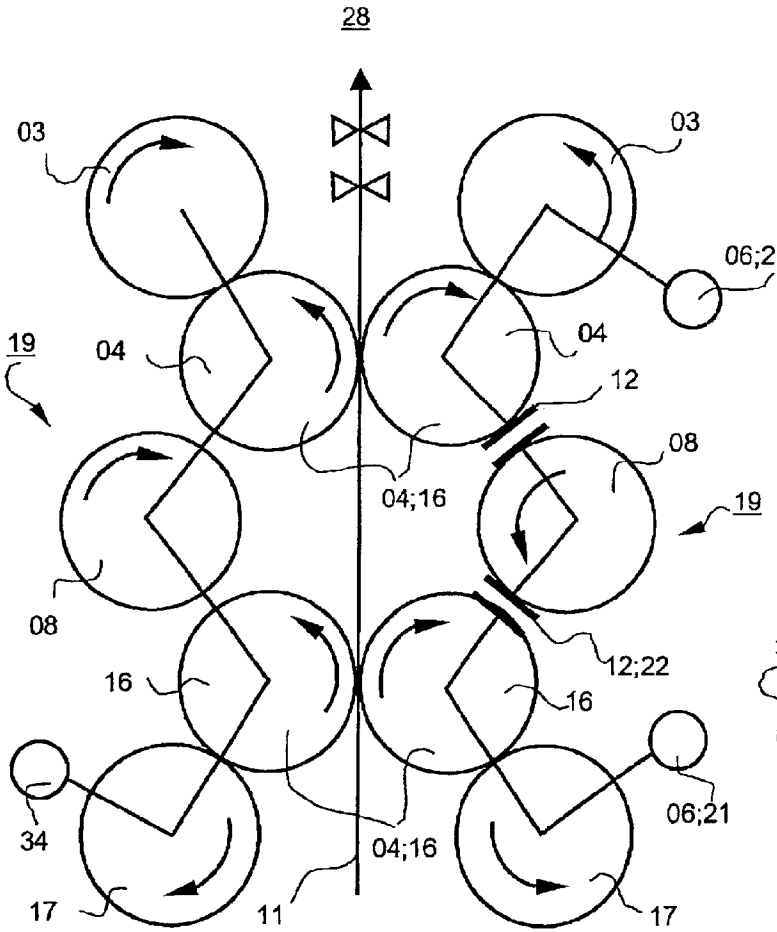

For example, the ten-cylinder printing unit 28 represented in FIG. 23 has an imprinter functionality, as represented in FIG. 22 for the nine-cylinder printing unit 27. In addition, it can be changed between a rubber-against-steel operation and a rubber-against-rubber operation if it is embodied with an appropriate pivotable bearing for one or for several of the transfer cylinders 04, 16. In contrast to the pivoting of the transfer cylinders 04, 16 in a single five-cylinder printing unit 19, such as represented in FIGS. 19 to 22, in this configuration two transfer cylinders 04, 16 of two five-cylinder printing units 19, which are arranged almost symmetrically next to each other, are placed against each other for the rubber-against-rubber operation.

Figure 24:
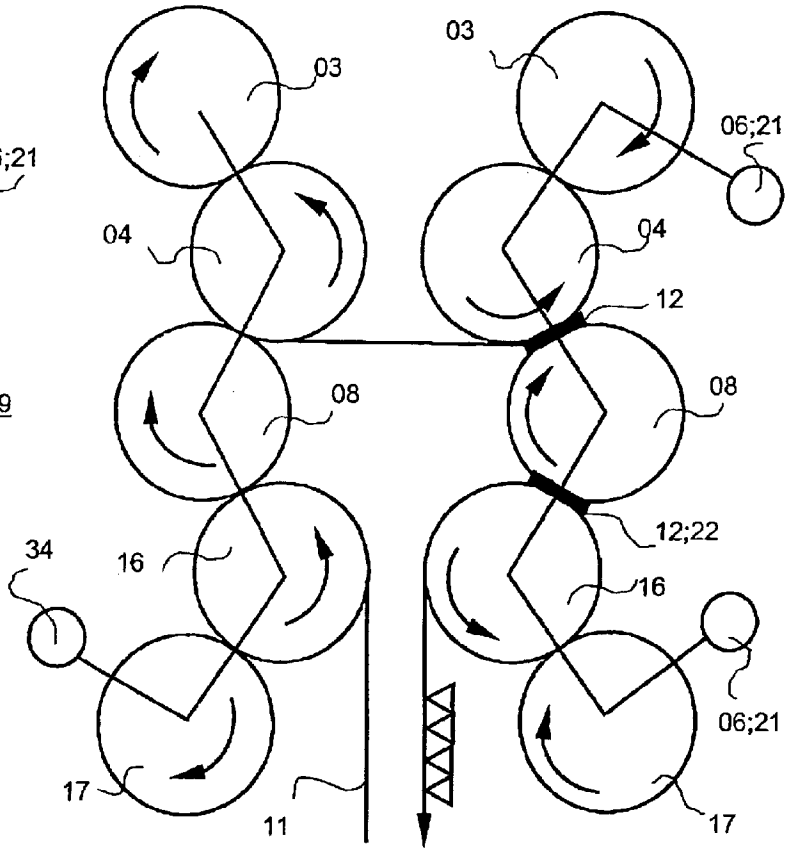
Figure 25:
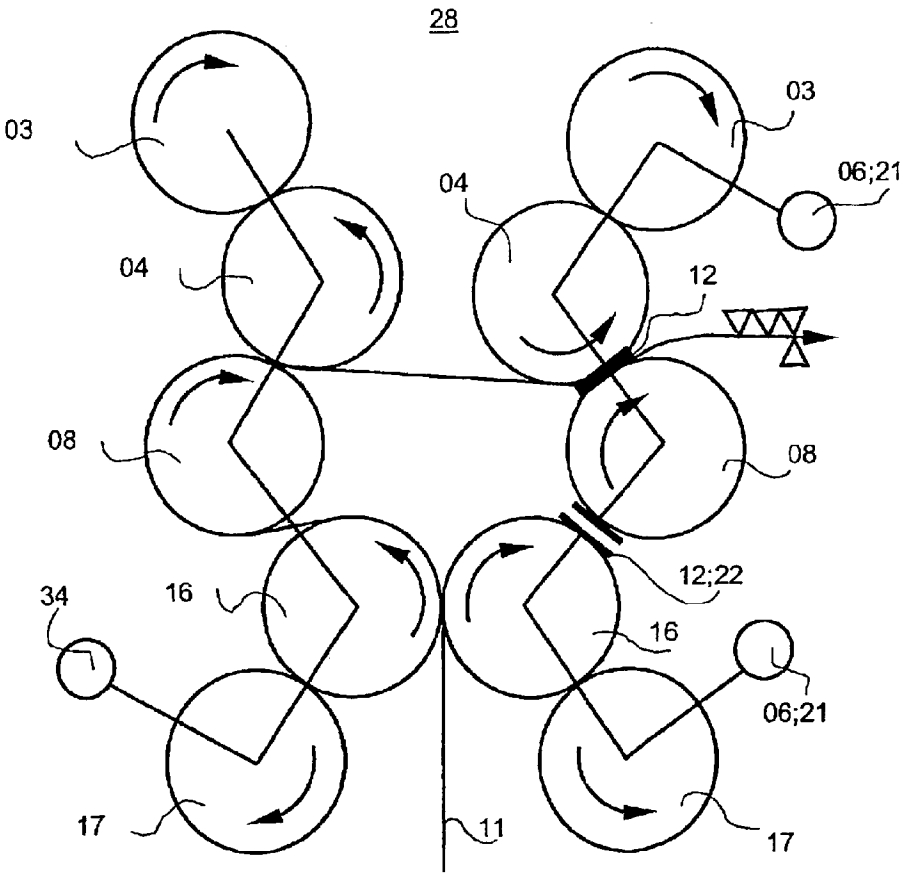

If, for example, the guidance of the web 11 is provided only from below and with 3/1 printing only in the direction of a predefined side, a configuration with a total of only three drive motors 06, 21, 34 and two connectors 12, 22 in accordance with FIGS. 23 to 25 is sufficient for accomplishing all of the above-mentioned functions in regard to imprinter functionality and reversing possible.

FIG. 23 shows an example of the paper guidance in a 2/2 printing operation, FIG. 24 in 4/0 printing operation, and FIG. 25 in 3/1 printing operation. If increased flexibility regarding the guidance of the web 11 is required, a fall-back to the configuration in FIG. 14 can be made.

While preferred embodiments of printers comprising a drive assembly and a coupling, in accordance with the present invention, have been set forth fully and completely hereinabove, it will be apparent to one of skill in the art that changes in, for example the overall sizes of the cylinders, the specific nature of the web being printed and the like could be made without departing from the true spirit and scope of the present invention which is accordingly to be limited only by the following claims.

What is claimed is:

1. A printing unit comprising:

a first pair of cooperating cylinders including a first forme cylinder and a first transfer cylinder;

a first satellite cylinder cooperative with said first transfer cylinder to form a first print location;

a first drive mechanism for said first forme cylinder and a first drive mechanism for said first transfer cylinder, said first forme cylinder drive mechanism and said first transfer cylinder drive mechanism being fixedly connected;

a common first drive motor forming a fixed drive assembly with said first forme cylinder and said first transfer cylinder during printing;

a satellite cylinder drive mechanism; and a selectively switchable first connector between said satellite cylinder drive mechanism and said fixed drive assembly of said first pair of cooperating cylinders.

2. The printing unit of claim 1 wherein said first drive motor is arranged to drive said first forme cylinder.

3. The printing unit of claim 1 wherein said first drive motor is arranged to drive said first transfer cylinder.

4. The printing unit of claim 1 further including a gear interposed between selectively at least one of said first drive motor and said first transfer cylinder.

5. The printing unit of claim 1 wherein said satellite cylinder is a steel cylinder.

6. The printing unit of claim 1 wherein said satellite cylinder drive mechanism includes a satellite cylinder drive motor.

7. The printing unit of claim 1 further including a second pair of cooperating cylinders including a second forme cylinder and a second transfer cylinder.

8. The printing unit of claim 7 wherein said first satellite cylinder cooperates with said second transfer cylinder and forms a second print location.

9. The printing unit of claim 7 further including a drive mechanism for said second forme cylinder and a drive mechanism for said second transfer cylinder, said satellite cylinder drive mechanism and said second transfer cylinder drive mechanism being independent of each other.

10. The printing unit of claim 7 further including a drive mechanism for said second forme cylinder and a drive mechanism for said second transfer cylinder, said satellite cylinder drive mechanism and said second transfer cylinder drive mechanism being coupled with each other.

11. The printing unit of claim 10 further including a second switchable connector between said satellite cylinder drive mechanism and said second transfer cylinder drive mechanism.

12. The printing unit of claim 7 further including a drive mechanism for said second forme cylinder and a drive mechanism for said second transfer cylinder, said second forme cylinder drive mechanism and said second transfer cylinder drive mechanism being mechanically independent of each other.

13. The printing unit of claim 7 further including a drive mechanism for said second forme cylinder and a drive mechanism for said second transfer cylinder, said second forme cylinder drive mechanism and said second transfer cylinder drive mechanism being coupled with each other.

14. The printing unit of claim 13 further including a third switchable connector coupling said second forme cylinder drive mechanism and said second transfer cylinder drive mechanism.

15. The printing unit of claim 7 wherein said second pair of cooperating cylinders is absent a drive mechanism.

16. The printing unit of claim 7 wherein said pair of cooperating cylinders is provided with at least one second pair of cooperating cylinders drive motor.

17. The printing unit of claim 16 wherein said second cooperating pair of cylinders drive motor is arranged at said second forme cylinder.

18. The printing unit of claim 16 wherein said second cooperating pair of cylinders drive motor is arranged at said second transfer cylinder.

19. The printing unit of claim 7 wherein said second pair of cooperating cylinders is engageable with a further drive assembly.

20. The printing unit of claim 1 further wherein said printing unit is part of one of a seven-cylinder, a nine-cylinder and a ten-cylinder printing unit.

21. The printing unit of claim 1 further including a second pair of cooperating cylinders including a second forme cylinder and a second transfer cylinder, said first pair of cooperating cylinders and said second pair of cooperating cylinders both cooperating with said satellite cylinder to form first and second print locations, said fixed drive assembly and said satellite cylinder drive mechanism being selectively coupled.

22. The printing unit of claim 21 wherein said first pair of cooperating cylinders and said second pair of cooperating cylinders constitute a drive mechanism drivable by said common first drive motor.

23. The printing unit of claim 21 wherein said first pair of cooperating cylinders and said second pair of cooperating cylinders each form a fixed drive assembly having its own drive motor, said satellite cylinder drive mechanism being selectively coupled to each of said fixed drive assemblies.

24. The printing unit of claim 1 further including a second pair of cooperating cylinders including a second forme cylinder and a second transfer cylinder, a third pair of cooperating cylinders including a third forme cylinder and a third transfer cylinder, and a fourth pair of cooperating cylinders including a fourth forme cylinder and a fourth transfer cylinder, said first, second, third and fourth transfer cylinders cooperating with said satellite cylinder to form said first print location.

25. The printing unit of claim 24 further including a second drive mechanism for said second forme cylinder and a second drive mechanism for said second transfer cylinder of said second pair of cooperating cylinders, said second drive mechanism being fixedly connected and being located adjacent said first pair of cooperating cylinders about said satellite cylinder, said fixedly connected first and second drive mechanisms forming two coupled pairs, said two coupled pairs being driven by said common first drive motor.

26. The printing unit of claim 24 further including a second drive mechanism for said second forme cylinder and a second drive mechanism for said second transfer cylinder, said drive mechanisms of said first and second pairs of cooperating cylinders being fixedly mechanically coupled to each other and each being driven during printing by said first drive motor which together with each said coupled pair and said satellite cylinder drive mechanism can be selectively coupled by said selectively switchable first connection.

27. The printing unit of claim 24 wherein said printing unit includes a second satellite cylinder.

28. The printing unit of claim 25 wherein said printing unit includes a second satellite cylinder.

29. The printing unit of claim 26 wherein said printing unit includes a second satellite cylinder.

30. The printing unit of claim 27 wherein said pairs of cooperating cylinders are selectively coupled to one of said first and second satellite cylinders.

31. The printing unit of claim 28 wherein said pairs of cooperating cylinders are selectively coupled to one of said first and second satellite cylinders.

32. The printing unit of claim 29 wherein said pairs of cooperating cylinders are selectively coupled to one of said first and second satellite cylinders.

33. The printing unit of claim 24 further including a common drive motor for each of said second, third and fourth pairs of cooperating cylinders.

* * * * *